US005736006A

United States Patent [19]

Prough

[11] Patent Number: 5,736,006

[45] Date of Patent: Apr. 7, 1998

[54] METHOD AND APPARATUS FOR PULPING WITH CONTROLLED HEATING TO IMPROVE DELIGNIFICATION AND PULP STRENGTH

[75] Inventor: J. Robert Prough, Tarpon Springs, Fla.

[73] Assignee: Ahlstrom Machinery Inc., Glens Falls, N.Y.

[21] Appl. No.: 729,022

[22] Filed: Oct. 10, 1996

[51] Int. Cl.[6] ..... D21C 1/10

[52] U.S. Cl. ..... 162/52; 162/17; 162/19; 162/29; 162/37; 162/68; 162/237; 162/246

[58] Field of Search ..... 162/17, 19, 29, 162/37, 52, 68, 237, 246

[56] References Cited

U.S. PATENT DOCUMENTS

| | | | |
|---|---|---|---|
| 3,215,588 | 11/1965 | Kleinert | 162/19 |
| 3,619,348 | 11/1971 | Asplund et al. | 162/19 |
| 3,664,918 | 5/1972 | Clayton et al. | 162/19 |
| 4,632,729 | 12/1986 | Laakso | 162/17 |
| 5,053,108 | 10/1991 | Richter | 162/237 |
| 5,183,535 | 2/1993 | Tikka | 162/19 |
| 5,213,662 | 5/1993 | Henricson | 162/19 |
| 5,302,247 | 4/1994 | Richardsen et al. | 162/42 |
| 5,346,591 | 9/1994 | Henricson | 162/249 |
| 5,476,572 | 12/1995 | Prough | 162/246 |
| 5,489,363 | 2/1996 | Marcoccia et al. | 162/43 |
| 5,500,083 | 3/1996 | Johanson | 162/17 |

OTHER PUBLICATIONS

Gullichsen et al, 1995 Pulping Conference "On the Importance of Impregnation and Chip Dimensions on the Homogeneity of Kraft Pulping", pp. 227–234, Tappi Proceedings (Oct., 1995).

Cameron Hydraulic Data, 1981, Ingersoll–Rand, Woodcliff Lake, New Jersey, pp. i–iii, v, Section 1 (pp. 1–1 through 1–47).

*Primary Examiner*—Donald E. Czaja
*Assistant Examiner*—Steven B. Leavitt
*Attorney, Agent, or Firm*—Nixon & Vanderhye P.C.

[57] ABSTRACT

Low temperature steaming and slurrying of wood chips results in significant improvement in treatment, the chips being maintained at a temperature below 110° C. (more desirably at about 105° C. or less, and most desirably at about 100° C. or less) until actually heated to cooking temperature. Steaming may be accomplished utilizing a vertical chip bin with one dimensional convergence and side relief or a horizontal steaming vessel, the steaming device connected to a high pressure feeder. A pump having an NPSHR less than the NPSHA may be used for drawing slurry into the high pressure feeder from the steaming device, or a pump may be disposed between the steaming device and the high pressure feeder for forcing slurry into the high pressure feeder through a conduit including a radiused elbow. The steaming is practiced at a pressure of 5 psig or less, preferably substantially atmospheric steaming is practiced. The pulp produced typically has strength properties at least about 10% greater than the pulp produced from material where it is steamed and slurried at temperatures in excess of 110° C.

20 Claims, 7 Drawing Sheets

METHOD AND APPARATUS FOR PULPING WITH CONTROLLED HEATING TO IMPROVE DELIGNIFICATION AND PULP STRENGTH

BACKGROUND AND SUMMARY OF THE INVENTION

In the chemical pulping of fibrous, cellulosic material for producing paper and board, the raw material is treated with chemicals, for example, sodium and sulfur compounds, at elevated temperature. Typically, this treatment is performed at superatmospheric pressure to ensure the aqueous solutions remain in liquid form. The chemicals react with the organic and non-organic constituents of the raw material such that some of the organic and non-organic constituents are dissolved to yield a product consisting of cellulose fibers in an aqueous slurry of dissolved reaction products. The slurry is typically cleaned and dewatered to provide an essentially pure form of cellulose fibers for paper making.

In order to provide a cost effective method of chemical pulping, the pulp and paper maker is interested in a process that utilizes the least energy, the least cooking chemicals and produces a pulp that, if desired, is easily bleached (that is, the pulp consumes a minimum amount of bleaching chemical) and has the strongest strength properties. The stronger the pulp, the more strain it can withstand on the paper machine and the faster the paper machine can be run.

One of the most significant requirements of chemical pulping is that the comminuted cellulosic fibrous material be properly steamed prior to the introduction of cooking chemicals. The comminuted cellulosic fibrous material, for example, softwood chips, entering the pulping process typically contain significant volumes of air. This air hinders the penetration of cooking chemicals into the chips. In order to effectively penetrate the chips with cooking liquor this air must be removed. Furthermore, the evacuation of air from the chips is necessary to ensure that the chips sink during the pulping process and do not tend to float.

This evacuation of air is initiated in the steaming process. The chips, or other comminuted cellulosic fibrous materials, are exposed to steam in a controlled fashion such that the air is displaced with steam which condenses within the chips. Upon exposure to cooking chemicals the condensate-saturated chip more readily absorbs and retains the cooking chemical than if pockets of air were present. This ideal uniform absorption of cooking chemical promotes uniform treatment of the chip requiring less energy and less cooking chemicals-and a stronger, more uniform pulp product results.

Typically for conventional continuous pulping systems the steaming process is initiated in cylindrical vessels, or chip bins, having agitators on the bottom to agitate the chip column and ensure a continuous discharge of chips. Typically steam is added to these atmospheric vessels to initiate the steaming process. However, due to the restrictive geometry of these vessels and due to the agitation, the movement of the chips within the vessel is typically non-uniform. As a result the exposure to steam and the retention time in these vessels is also typically non-uniform. Due to this non-uniformity of steaming in such vessels, these vessels are typically followed by a pressurized steaming vessels, for example, horizontal steaming vessels having a screw conveyor. This pressurized pretreatment improves the effectiveness of the steaming process but also inherently increases the temperature of the chips.

After this steam treatment, cooking liquor is conventionally introduced to the chips to produce a heated slurry of chips and liquor. This slurry is then typically transported via a high pressure transfer device, for example a High-pressure feeder sold by Ahlstrom Machinery, to a cooking vessel, that is, a digester or impregnation vessel. During this transfer, the chips are typically further heated by exposure to hotter cooking liquors. The temperature of the slurry is raised further to cooking temperature (140°–180° C.) prior to or in the digester.

However, recently it has been discovered that over-heating the comminuted cellulosic fibrous material during the steaming treatment or during the transfer process can have detrimental effects upon the quality of the pulp produced. For example, as a result of over-heating in the pretreatment stage, less undesirable lignin may be removed from the material, that is, less delignification occurs, in the formal cooking stage. Also, over-heating can cause damage to the cellulose material such that the strength of the resulting paper is reduced. The present invention relates to a method and apparatus for treating comminuted cellulosic fibrous material such that the heating of the material is controlled to minimized the detrimental effects of over-heating during the pretreatment stage on the extent of delignification and the strength of the resulting paper. This process is also more energy efficient than conventional pulping processes. This invention also includes the pulp produced by this process.

U.S. Pat. No. 5,500,083 discloses a novel apparatus and method for steaming comminuted cellulosic fibrous material. This apparatus, sold under the trademark DIAMONDBACK® by Ahlstrom Machinery of Glens Falls, N.Y., employs a bin geometry having single (one dimensional)-convergence with side-relief, that permits dramatically improved treatment of the chips. In addition to eliminating the need for agitation in the outlet of a vertical steaming vessel, the DIAMONDBACK® steaming vessel dramatically improves the uniformity with which chips are exposed to steam. For example, where the conventional steaming of chips under atmospheric conditions in a cylindrical bin with vibratory discharge requires a separate pressurized steaming, for example, in a horizontal, screw-type steaming vessel, the DIAMONDBACK® vessel uniformly exposes the chips to steam under atmospheric conditions such that no pressurized steaming, and the pressure vessel required, are necessary. This uniform steaming time is only presently achievable in a DIAMONDBACK® steaming vessel. In order to achieve the quality of steaming possible in a DIAMONDBACK® steaming vessel in conventional systems requires much longer exposure times, that is, longer retention times. Such prolonged exposure to steam in conventional equipment only results in non-uniform treatment and wasted energy. Furthermore, since the steaming of the chips is so much more uniform and effective in a DIAMONDBACK® bin, the steaming process need not be pressurized. This has the further benefit that the chips are not prematurely exposed to elevated steam temperatures, that is, due to steaming with superheated steam, prior to the formal pulping process. Thus the DIAMONDBACK® bin now permits the treatment of the chips at lower temperatures prior to formal cooking than was heretofore possible.

In copending application Ser. No. 08/460,723 filed on Jun. 2, 1995 (the disclosure of which is hereby incorporated by reference herein), a novel process of treating comminuted cellulosic fibrous material prior to chemical digestion was introduced. In this application it was disclosed that prior to or during the initial treatment of comminuted cellulosic fibrous material, for example, softwood chips, with alkaline cooking liquors, naturally-occurring acidic substances in the furnish can damage the cellulose material and negatively affect subsequent pulp strength. In order to minimize the effect of these acidic materials upon the pulp strength, application Ser. No. 08/460,723 discloses a process for pretreating the material with an alkaline liquid at a relatively low temperature, for example less than 110° C. (230° F.), for about 0.5–72 hr., preferably 1–4 hours, with a relatively low alkali content (e.g. 1.0 mole/liter or less), so that the formation of detrimental acidic materials is retarded if not eliminated entirely.

Furthermore, it has since been found that in actual pulp mill operation, when the temperature of the pretreatment, for example impregnation, is decreased, the degree of cooking—as indicated by the resulting pulp's "kappa number"—is surprisingly increased. Where previously a reduction in pretreatment temperature would have been expected to produce an increase in the kappa number, that is, less lignin removal, the kappa number actually decreased when the temperature was decreased. In one instance, when the pretreatment temperature was decreased from approximately 240° F. to approximately to 200° F. the kappa number decreased from approximately 23 to approximately 20. In another instance, when the pretreatment temperature was decreased from approximately 235° F. to approximately to 215° F., the kappa number decreased from approximately 20 to approximately 18. Both these temperature drops imply a significant energy savings in manufacturing the pulp. The reduction in kappa number also suggests that a significant savings in bleaching chemical may also be achievable.

In subsequent in-mill testing it was discovered that a decrease in the pretreatment temperature allowed the mill digester operators to decrease the cooking temperature. For example, where in a conventional "high" temperature pretreatment the cooking temperature required in the cooking zone to achieve a desired kappa number was approximately 332° F., when a cooler temperature was used for pretreatment in conjunction with the process disclosed in U.S. Pat. No. 5,489,363 (and marketed under the trademark LO-SOLIDS by Ahlstrom Machinery), a cooking temperature of only approximately 322° F. could be used while still achieving the desired degree of delignification, that is, kappa number. Furthermore, even more surprisingly, and similar to the disclosure of Ser. No. 08/460,723, though the delignification of the pulp increased, the strength of the pulp produced by the cooler pretreatment increased. For example, when employing this low temperature pretreatment with LO-SOLIDS pulping in lab-scale tests, the tear at tensile for one pulp increased 30% compared to a pulp produced from the same furnish using typical higher pretreatment temperatures.

In contrast to the interpretation of the findings of copending application Ser. No. 08/460,723, though the actual mechanism is not fully understood, this reduction in kappa number, or in the degree of cooking, is generally attributed to the reduced consumption of cooking chemicals, that is, active alkali (AA), during the pretreatment process. It is hypothesized that since less cooking chemical is consumed during pretreatment, for the same chemical charge, more chemical is available during the cooking stage. The increased cooking chemical present in the cooking stage, at the same cooking temperature, accelerates the reaction between cooking chemicals and the furnished material. But again, surprisingly, though the delignification reaction appears to have been accelerated and resulted in a lower kappa number, reactions between cooking chemicals and the cellulose appears to have been retarded such that the resulting pulp fiber strength is increased.

The process of this invention can have a dramatic impact upon conventional continuous and batch chemical pulping methods. However, the methods and apparatuses of the conventional art of feeding and pretreating comminuted cellulosic fibrous material prior to chemical pulping are not amenable to utilizing this low temperature pretreatment without some form of modification. For example, due to the requirement for pressurized steaming in the prior art, and the concomitant heating, feeding and treating at low temperature is precluded. Some form of cooling mechanism can be inserted between pressurized steaming and low temperature pretreatment but such a form of operation is very energy inefficient. However, the unpressurized steaming of U.S. Pat. No. 5,500,083, that is, using a DIAMONDBACK® steaming vessel, permits steaming and pretreatment without the undesirable heating without wasting energy.

Another method and apparatus which are ideally suited to this low temperature treatment are disclosed in U.S. Pat. No. 5,476,572 and are marketed under the trademark LO-LEVEL™ by Ahlstrom Machinery of Glens Falls, N.Y. The LO-LEVEL feeding system can inherently feed comminuted cellulosic fibrous material to a digester, continuous or batch, at a lower temperature, typically less than 110° C. (230° F.), preferably less than 105° C. (221° F.), ideally less than approximately 100° C. (212° F.), and thus is advantageous for practicing the low temperature treatment described herein. However, the operation of other conventional systems for feeding and treating comminuted cellulosic fibrous material prior to digestion can be modified to accommodate the lower temperatures of this invention.

U.S. Pat. No. 5,302,247 discloses a method and apparatus for cooling the transfer line between a high-pressure feeder and a continuous digester, that is, the "top circulation line" or "TC line". However, the method and apparatus disclosed in Ser. No. 5,302,247 are exclusively used to cool the transfer line to prevent hydraulic hammering and damage to the transfer equipment. Nowhere in this patent is it disclosed that such cooling means can be used to effect a treatment of the slurry being transferred to improve the results of the cooking process. Though the temperature of the slurry in the transfer line is not disclosed, one skilled in the art could only assume that the preferred pulp slurry temperature would be as is conventional, that is, between approximately, 230° and 250° F. (110°–121° C.). Since this temperature range can be exceeded when the cooking liquor is used in a downstream modified cooking process, the cooling means of this patent are employed to maintain the transfer line temperature within this range.

According to one aspect of the present invention, a method is provided for treating a comminuted cellulosic fibrous material for producing cellulose pulp. The method comprises the following steps: (a) Steaming the material so as to remove the air therefrom and heat the material to a temperature of less than 110° C. (b) Substantially immediately after step (a), slurrying the material with liquor, including cooking liquor, having a temperature of 110° C. or less so that the slurry has a temperature of about 110° C. or less. [that is without any intervening positive cooling or storing stages or the like] (c) Pressurizing the slurry and hydraulically feeding it to a treatment vessel, the temperature of the slurry being maintained at about 110° C. or less during pressurizing and feeding to the treatment vessel. And (d) in the treatment vessel raising the slurry temperature to a cooking temperature of at least 140° C. by bringing the material into contact with hot liquid. The pulp produced (especially when the maximum temperature in steps (a)–(c) is about 100° (or less)) typically has strength properties at least 10% greater (e.g. at least 20% greater) than pulp produced when the temperatures in steps (a)–(c) are greater than 110° C.

Preferably steps (b) and (c) are practiced so that the material has a temperature of about 105° C. or less at about 3 psig, or less, more preferably at about 100° C. or less at substantially atmospheric pressure. Also, step (a) may be practiced for a time period of between about 10–60 minutes, more preferably between about 15–35 minutes, and most preferably between about 20–30 minutes, at substantially atmospheric pressure, with a DIAMONDBACK® steaming vessel or chip bin (with one dimensional convergence and side relief). The DIAMONDBACK® chip bins have a top and a bottom, and a conveyor including a housing (e.g. a substantially horizontally elongated tube) with an internal shaft and a conveying element may be disposed above the steaming vessel for feeding the comminuted cellulosic material to the steaming vessel. There may then be the further step (e) of establishing an interior plug seal in the conveyor housing and an outlet thereof to the steaming vessel by providing a restriction thereat (that is adjacent the outlet). Step (e) may be practiced by providing a hinged plate adjacent the outlet from the conveyor housing to the steaming vessel, or by providing a stationary plate and controlling the speed of rotation of the shaft, as described in copending application Ser. No. 08/713,431 filed Sep. 13, 1996(atty. dkt. 10-1194).

The present invention may also be effected using conventional feeding equipment. However, the novel low-temperature nature of this invention requires that, to effect such treatment, conventional systems must be modified or operated in an unconventional fashion.

As discussed above, the chemical pulping of comminuted cellulosic fibrous material is performed at temperatures near or above the boiling point of water, that is, 100° C. at standard atmospheric pressure. Since the solutions used to treat the material are typically aqueous solutions having boiling points approximately the same as water, the potential for liquid boiling or "flashing" must be minimized especially when transferring the liquid, for example by pumps. Flashing not only interferes with the process chemistry but can also cause damage to the vessels, piping and other components. Flashing is typically prevented by pressurizing the system above atmospheric pressure such that the boiling point of the liquid typically exceeds 100° C. However, the performance of liquid transfer equipment, for example, centrifugal pumps, is highly sensitive to the prevailing liquid boiling point. For example, what is known as a pump's Net Positive Suction Head (NPSH) must be accommodated when handling liquids at or above their boiling points.

As explained in Cameron Hydraulic Data, 1981, the Net Positive Suction Head Required (NPSHR) is the pressure that must be present at the inlet of pump in order for the pump to provide the specified performance, that is, pressure and flow volume that appear on the pump curve. The Net Positive Suction Head Available (NPSHA) in a system to exceed the NPSHR is a function of several variables, including: the prevailing gas pressure in the system, the level of liquid above the inlet of the pump, the pressure drop across any intermediate devices, the vapor pressure of the liquid being pumped, the pressure and temperature of the liquid, the dynamic line loss in the connecting piping and the pump used. Though one or all of these variables may be varied to achieve a NPSHA above the NPSHR, there are several preferred options for achieving this.

According to the present invention, an apparatus may be provided for treating a slurry of comminuted cellulosic fibrous material at a temperature below 110° C. (230° F.) and feeding it to a digester. The apparatus may comprise: A means for introducing comminuted cellulosic fibrous material. A vessel for steaming the material, at atmospheric pressure or slightly higher, to remove excess air and begin the heating process, having an outlet [that is, a chip bin, DIAMONDBACK® steaming vessel, or whatever]. A transfer conduit having a first end connected to the steaming vessel outlet and having a second end [that is, a chip chute]. A high-pressure transfer device having a low-pressure inlet connected to the second end, a low-pressure outlet, a high-pressure inlet and a high-pressure outlet which communicates with the digester [that is, a HPF]. A pump having an inlet connected to the low-pressure outlet for drawing the slurry into the high-pressure transfer device and an outlet [that is, a chip chute circulation pump]. A recirculation loop having a first end connected to the pump outlet and a second end connected to the transfer conduit [that is, a chip chute circulation]; and a means for controlling the temperature and pressure in the inlet of the pump so that the net positive suction head required (NPSHR) by the pump is exceeded while the slurry temperature does not exceed 110° C.

The temperature of the slurry is preferably as low as possible while not affecting the operation of any of the other equipment, for example the pump, or imposing excess energy requirements for the pulp mill. The slurry temperature may be less than 105° C. (221° F.) or preferably less than 100° C. (212° F.).

One means of ensuring an NPSHR at the pump inlet is to use a pump having a lower NPSHR. For example, a centrifugal pump with an inducer can be used such as the "Hidrostal" pump manufactured by Wemco of Salt Lake City, Utah. This type of pump or its equivalent has an NPSHR that is typically at least 20% lower than conventional centrifugal pumps.

Another option that can be used to limit NPSHR is to vary the pump speed. For example, a variable speed motor can be used to vary the pump speed and thus reduce the pumps NPSHR. Typically, the change in speed required to effect a change in NPSHR is dependent upon the pump used. Another method of ensuring an adequate NPSHA is to increase the liquor level, or static head, above the high-pressure transfer device or above the pump.

Utilizing the system as described above in step (b) the method earlier described may be practiced in a particular way. That is (b) is practiced using: a substantially vertical chute from a horizontal steaming vessel; a high pressure feeder at the bottom of the chute, the chute comprising a low pressure inlet to the high pressure feeder: a low pressure outlet from the high pressure feeder; a high pressure inlet to and a high pressure outlet from the high pressure feeder; and a low pressure pump connected between the low pressure outlet from the high pressure feeder and the chute; and wherein the low pressure pump has a net positive suction head required which is less than a net positive suction head available, the net positive suction head available=

$$NPSHA=P_{SV}+H_1-\Delta P_{HPF}+H_2-H_{VP}>NPSHR \quad (1)$$

wherein $P_{SV}$=the pressure in the horizontal steaming vessel outlet; $H_1$ is the static head of the liquid above the high pressure feeder; $\Delta P_{HPF}$ is the pressure drop across the high pressure feeder; $H_2$ is the static head between the high pressure feeder and the low pressure pump inlet; and $H_{VP}$ is the vapor pressure of the liquid between the low pressure outlet from the high pressure feeder and the low pressure pump inlet, the value of $H_{VP}$ being dependent upon the temperature of the liquid; and wherein steps (b) and (c) are practiced so that the temperature in the chute is controlled so that the net positive suction head required for the low pressure pump is provided while the temperature in the chute is maintained at about 110° C. or below.

According to another aspect of the present invention a method of treating comminuted cellulosic fibrous material, using a high pressure transfer device and a liquid transfer device, is provided. The method comprises the following steps: (a) Steaming the material so as to remove the air therefrom and heat the material to a temperature of 110° C. or less. (b) Substantially immediately after step (a), slurrying the material with liquor, including cooking liquor, having a temperature of 110° C. or less so that the slurry has a temperature of 110 ° C. or less. (c) Drawing the slurry of step (b) into the high-pressure transfer device using the liquid transfer device. (d) Pressurizing the slurry in the high pressure transfer device and hydraulically feeding the slurry from the high pressure transfer device to a treatment vessel, the temperature of the slurry being maintained at about 110° C. or less during pressurizing and feeding to the treatment vessel. And, (e) in the treatment vessel, raising the slurry temperature to a cooking temperature of at least 140° C. by bringing the material into contact with hot liquid.

Step (c) is typically practiced by using as the liquid transfer device a pump which has an NPSHR less than the NPSHA, for example a centrifugal pump with an inducer which has an NPSHR that is about 20% lower than conventional centrifugal pumps. Steps (a)–(e) are preferably practiced to produce pulp having strength properties at least about 10% greater (e.g. at least about 20% greater) than pulp produced from material which has a temperature of greater than 110 ° C. during the practice of steps (a)–(d).

According to another aspect of the present invention apparatus for treating comminuted cellulosic material to produce cellulose pulp is provided. The apparatus comprises the following components: Means for steaming the material to a temperature of 110° C. or less at a pressure of about 5 psig or less, to remove air therefrom. A high pressure feeder (HPF) having an inlet connected to the steaming means and an outlet. Means for feeding steamed material from the steaming means and slurrying liquid to the high pressure feeder so that a slurry produced in the high pressure feeder has a temperature of 110° C. or less. And, a digester operatively connected to the high pressure feeder outlet.

The digester may be a continuous digester or batch digesters, and it may directly connected to the high pressure feeder outlet or operatively connected to an impregnation vessel or the like.

The means for steaming the material may comprise a horizontal steaming vessel, or a chip bin with one dimensional convergence and side relief, or conventional chip bins or other conventional steaming mechanisms typically used with continuous digesters. For example low pressure feeder valves may also be included. However preferably the steaming means is at a pressure of about 3 psig or less, typically substantially at atmospheric pressure.

The means for feeding steamed material may comprise means for forcing the slurry into the HPF inlet, or for drawing slurry into the inlet. Where drawing is utilized the feeding means may comprise a pump having an NPSHR less than the NPSHA, such as a centrifugal pump with an inducer, located on the opposite side of the HPF from the steaming means. Other pumps, as long as they do not result in the adverse consequences earlier and hereafter described, may alternatively be utilized.

Where the feeding means forces slurry into the HPF inlet, the feeding means may comprise a pump (such as a centrifugal pump with an inducer, or other conventional pumps) disposed between the steaming means and the high pressure feeder. The pump is preferably connected to the steaming means by a conduit including a radiused elbow so that the flow of slurry from the steaming means to the pump is smooth and unencumbered, being devoid of transitions that could stagnate flow.

The objects of the invention will become clear from an inspection of the detailed description of the invention and from the appended claims.

DETAILED DESCRIPTION OF THE DRAWINGS

Figure 1:
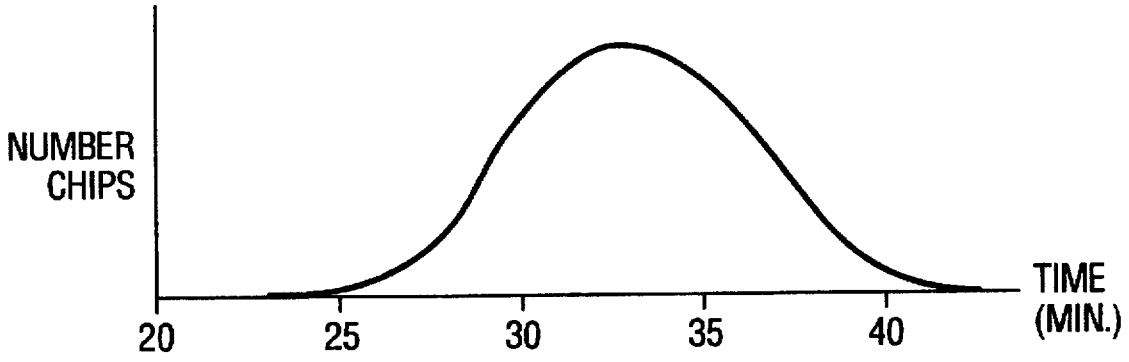
FIGS. 1 through 4 are various graphical representations of chips with respect to time in a chip bin.
Figure 2:
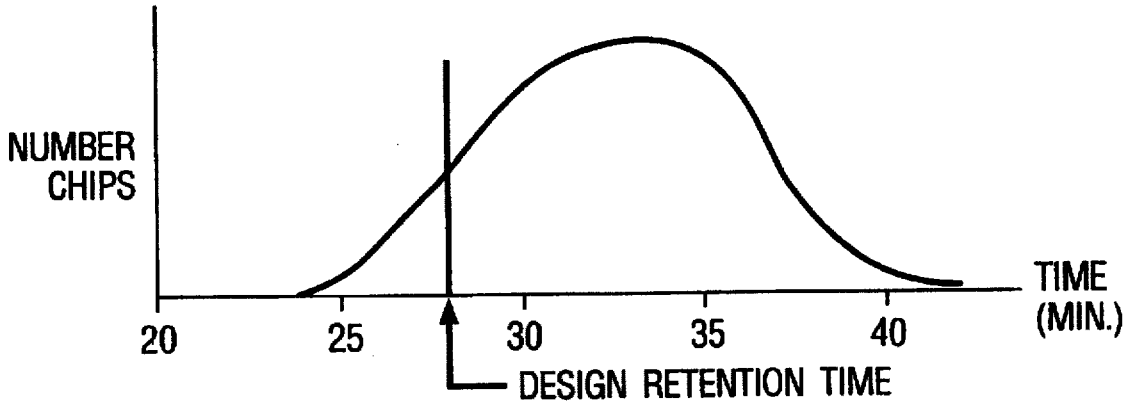
Figure 3:
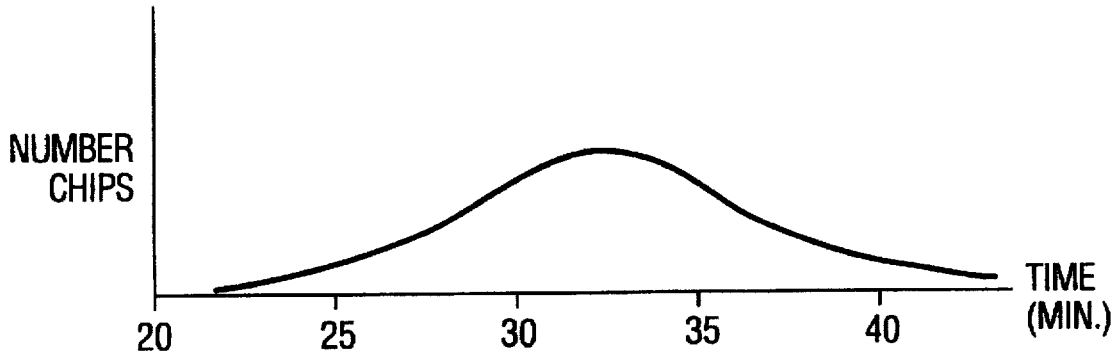
Figure 4:
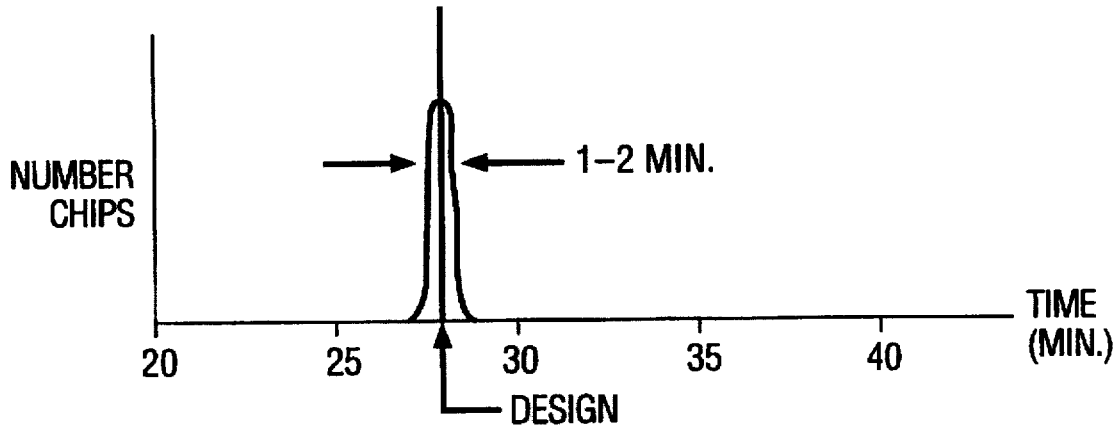

FIGS. 1 through 4 illustrate the dramatic improvement in the effectiveness of steaming, under atmospheric conditions, of comminuted cellulosic fibrous material that can be achieved when employing a DIAMONDBACK® steaming vessel, as sold by Ahlstrom Machinery and as described in U.S. Pat. No. 5,500,083(incorporated by reference herein). FIGS. 1 through 3 show the typical normal bell curve distribution of the exposure times, or retention times, for wood chips when passed through conventional chip bins have vibratory outlets. As shown in FIG. 2, though a typical retention time of only between 5–10 minutes is desired, the non-uniform movement of chips in such bins requires actual retention times that vary from approximately 5 to more than 20 minutes. FIG. 3 illustrates how this distribution is exacerbated when the chips are treated with steam. FIG. 4 illustrates the effect the use of a DIAMONDBACK® steaming vessel can have on the retention time. The uniform movement of chips in such a vessel results in a dramatically more uniform retention time. This uniform retention of the chips provides for a more uniform steaming of chips. A more uniform steaming results in a more uniform absorption of cooking chemical and a more uniform pulping process which results in a more uniform, stronger pulp.

Figure 5:
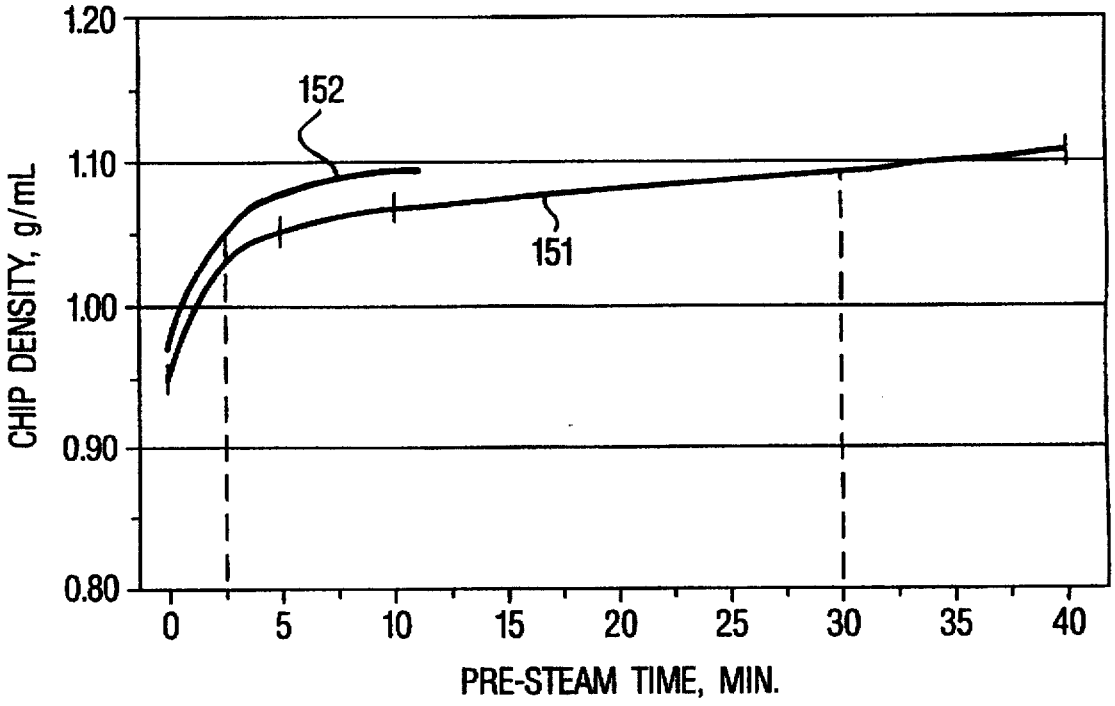
FIG. 5 is a graph illustrating chip density as a function of pre-steam time.

FIG. 5 illustrates a typical curve obtained from actual mill-scale trials showing the relationship of the effectiveness of chip presteaming to the time chips are exposed to steam in a DIAMONDBACK® Steaming Vessel. The effectiveness of the steaming process is indicated on the ordinate by the chip density in grams per milliliter(g/ml). A density of approximately 1.10 g/ml generally indicates that the chip has been completely impregnated with saturated steam and essentially all the air has been displaced from the chip. The abscissa is the time, in minutes, at which the chips were exposed to steam. Curve 151 illustrates that by using a DIAMONDBACK® vessel, under atmospheric pressure, chips are sufficiently steamed in approximately 20–30 minutes. Curve 152 illustrates the impact of steaming at superatmospheric conditions, for example, steaming at approximately 15 psig (1 bar gauge) and 250° F. (121° C.). Note that dramatic reductions in steaming time can be obtained by pressurizing the process. Not shown is the typical retention time required to steam chips at atmospheric conditions in conventional chip bins, for example, those with vibrating discharges. Such data is not available. Attempts to obtain sufficient steaming in a conventional atmospheric chip bin, without subsequent pressurized steaming have been unsuccessful. Excessive channeling of the chips, among other things, prevents such operation. Thus, in conventional systems in order to ensure adequate chip steaming in a reasonable amount of time, the steaming process must be performed at superatmospheric conditions, that is, the process must be pressurized. However, when employing a DIAMONDBACK™ steaming vessel the process need not be pressurized, that is, steaming can be performed at approximately 100° C. or slightly below, depending upon the atmospheric pressure. Such low-temperature and low-pressure steaming allows the chips to be conveyed to a cooking vessel at lower temperature. Such low temperature treatment is not possible using conventional equipment without employing some means of accommodating the effect upon the NPSH of the pumps and the pressure drops across other equipment.

Figure 6:
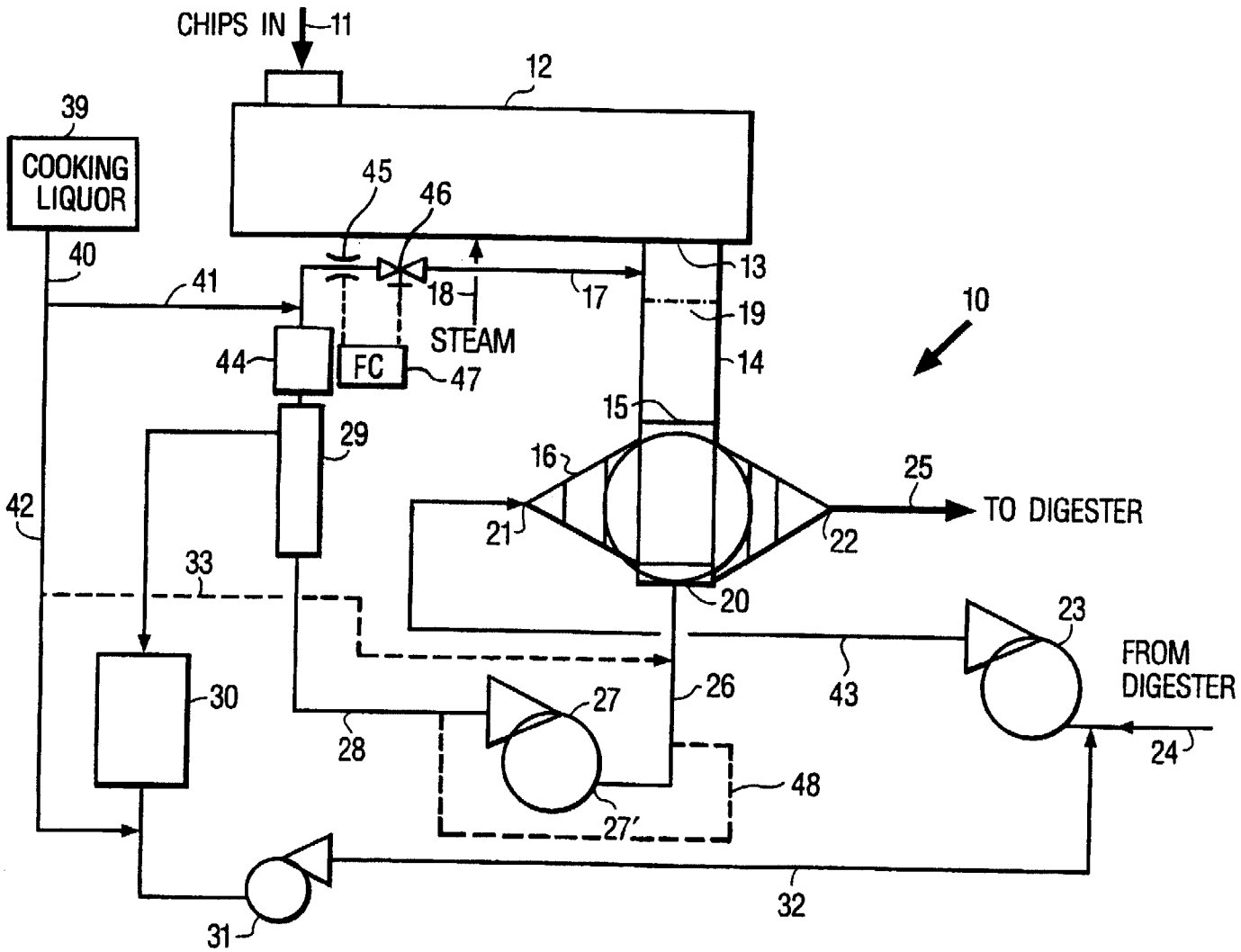
FIG. 6 is a schematic view illustrating exemplary apparatus for the practice of low temperature slurrying of comminuted cellulosic fibrous material according to the method of the present invention.

A system 10 for feeding comminuted cellulosic fibrous material, for example, softwood chips, according to the present invention is illustrated in FIG. 6. When the system of FIG. 6 is used in a typical, conventional, prior art mode, wood chips which have been pretreated, for example by steaming, are introduced at 11 to a horizontal screw conveyor 12 for example a steaming vessel as sold by Ahlstrom Machinery. The conveyor 12 is typically pressurized to a pressure of about 10 to 25 psig and the chips are typically introduced to the vessel by a pressure isolation device (not shown), for example a conventional Low-pressure Feeder as sold by Ahlstrom Machinery. Additional steam may be introduced to the horizontal conveyor, via conduit 18, so that when the chips are discharged from the outlet of the conveyor, 13, they are heated to between 250° to 270° F. and are at a pressure between about 10–25 psig.

The heated and pressurized chips are discharged from outlet 13 into a vertical chute or conduit, 14, where they are typically first exposed to cooking chemical. This conduit, for example a chip chute as sold by Ahlstrom Machinery, conveys the chips from the outlet 13 to the low-pressure inlet 15 of a high-pressure transfer device 16 such as a High-pressure Feeder (HPF) sold by Ahlstrom Machinery. Cooking liquor, for example, kraft white liquor, black liquor, green liquor, or mixtures thereof (which may contain strength or yield enhancing additives, such as polysulfide or anthraquinone, or their equivalents), is introduced via conduit 17 such that a liquor level 19 is created in the chute 14.

In addition to the low-pressure inlet 15, the transfer device 16 also includes a low-pressure outlet 20, a high-pressure inlet 21, and a high-pressure outlet 22. The high-pressure outlet 22 leads via conduit 25 to a digester, either continuous or batch, or to a pretreatment vessel, for example, an impregnation vessel (IV) as sold by Ahlstrom Machinery, if more than one cooking vessel is used. The high-pressure inlet 21 is connected to a high-pressure pump 23 via conduit 43. Pump 23 receives liquor from the digester or some other source of liquor via conduit 24. The low-pressure outlet 20 is connected via conduit 26 to pump 27 having an inlet 27'. Pump 27 returns liquor to the chute 14 via conduits 28 and 17. Also included in this recirculation loop is a conventional in-line drainer, 29, level tank, 30, and make-up liquor pump, 31, also supplied by Ahlstrom Machinery. Cooking liquor 39 is typically added to this system, via conduits 40, 41, and 42, at the inlet of the make-up liquor pump 31 and introduced to return flow 24 via conduit 32.

The HPF 16 shown in FIG. 6 typically includes a pocketed rotor assembly that sequentially accepts and discharges the chip slurry as it rotates and is exposed to the chip slurry in chute 14 and the high pressure of pump 23. The slurry in the chute 24 is drawn into the pockets in the HPF 16 with the aid of the suction of pump 27. The low-pressure outlet also typically includes a screen or strainer (not shown) which permits the passage of liquid but retains the chips. Such a system is referred to as a "draw-through" system since the chip slurry is drawn through the HPF 16. The chips which are retained by the screen are transferred by the liquor discharged by pump 23 to the digester via conduit 25. Other conventional HPFs can also be used.

In conventional feeding systems, the slurry that is discharged from the HPF 16 into conduit 25 is typically at a temperature of between approximately 110°–127° C. (230° to 260° F.). Due to the exothermic nature of the reaction of the cooking chemical with the wood material, the liquor returned from the digester via conduit 24 is typically at a temperature slightly higher, or approximately 112°–130° C. (234° to 266° F.). Even in the system disclosed in U.S. Pat. No. 5,302,247(that is, cooling the TC line when performing modified cooking) the typical temperature in transfer conduit 24 is between 110°–127° C. (230° to 260° F.). However, according to the present invention, it has been surprisingly discovered that reducing the temperature in conduit 25 as much as possible, for example, to less than 110° C. (230° F.), preferably less than 105° C. (221° F.), or most preferably less than 100° C. (212° F.), and then cooking the chips at between 140°–180° C. (284°–356° F.) to produce a pulp, yields a pulp containing less lignin and stronger fiber.

One method of achieving this lower temperature in conduit 25 is to introduce a cooled source of cooking liquor, 39. For example, introducing a cooler source of white liquor to conduit 40 will reduce the temperature of the liquor in conduits 32 and 24. Introducing this cooler liquor to the HPF will reduce the temperature of the slurry in conduit 25, as desired. Typically, the temperature of the cooled liquor 39 is typically less than 160° F. and preferably less than 130° F. (e.g. about 100°–130° F.). The liquor can be cooled via an indirect heat exchanger or the liquor may be flashed to cool it, or a combination of both methods, or any other method that reduces the temperature of the cooking liquor can be used. One preferred method of cooling is to introduce a cooling heat exchanger 44 somewhere in the conduits 28 and 17. The benefits of using such a method over cooling the cooking liquor are that it avoids the potential for precipitation in the more concentrated cooking liquor and it is more energy efficient than cooling the cooking liquor to a lower temperature. As shown in FIG. 6, the cooler liquor may be introduced to conduit 24, or it may be introduced to anywhere in the feed system where it is most advantageous to cool the slurry before entering conduit 25. This includes introducing cooler liquor to conduits 26, 28, 17, or directly to chute 14.

However, cooling the slurry after the chips have been steamed to temperatures greater than 110° C. is inherently thermally inefficient. It is simply thermally wasteful to first heat the chips and then cool them down. This is one of the reasons it is preferred to not to heat the chips up in the first place. One method of reducing the temperature of the chips existing in vessel 12 is to reduce the temperature of steam added to vessel 12, that is, to steam at a lower pressure. For example, instead of heating the chips in vessel 12 with steam to approximately 121° C. (250° F.) and 15 psig. It is preferable to heat the chips to only 110° C. (230° F.) at 6 psig or less, preferably about 105° C. (221° F.) at 3 psig or less, or even about 100° C. or less at substantially atmospheric pressure. This reduced temperature of the chips exiting the vessel 12 will reduce the amount of cooling required to achieve the lower temperature in conduit 25. As discussed above with reference to FIGS. 1–5, the DIAMONDBACK® chip bin sold by Ahlstrom Machinery is particularly suited for such low temperature, preferably atmospheric, steaming.

However, the temperature of the chips exiting vessel 12 dictates the pressure in vessel 12. Furthermore, the pressure in vessel 12 affects the NPSHA to provide the NPSHR for pump 27. This becomes more clear when discussed in reference to FIG. 7. This figure includes only vessel 12, the chute 14, the feeder 16, the conduit 26, and the pump 27 as shown in FIG. 6. Several pressure-related parameters are also illustrated. These include the pressure in the vessel 12, $P_S V$; the static head of the liquid above the feeder 16, H1; the pressure drop across the feeder 16, $\Delta P_{HPF}$; the static head of the liquid in conduit 26, H2; the vapor pressure of the liquid in conduit 26, $H_{VP}$ (which is a function of temperature); the temperature of the liquid in chute 14, T1; the temperature of the slurry in the conduit 25, T2; the temperature of the liquid in the conduit 26, T3; and the net positive suction head required (NPSHR) at the inlet of pump 27.

Figure 7:
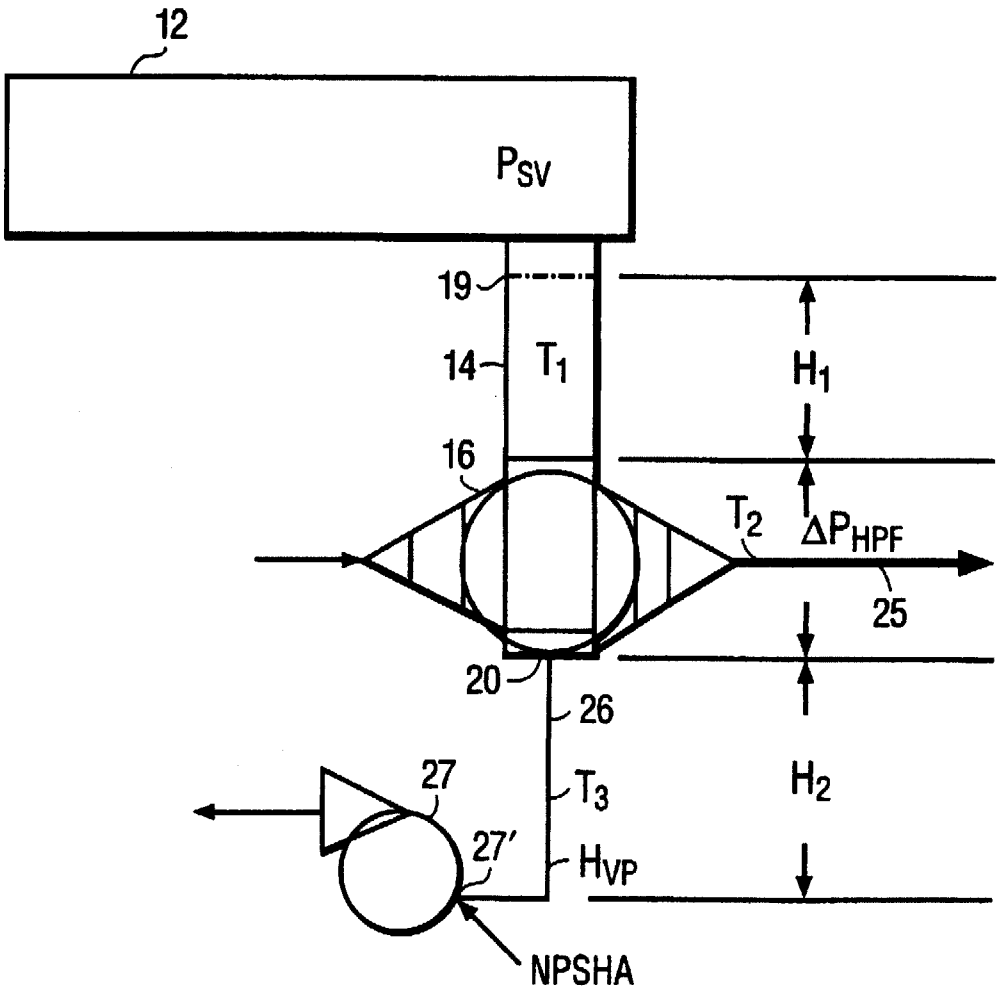
FIG. 7 is a view like that of FIG. 6 only showing various values which are utilized to insure proper operation of the pump connected to the low pressure outlet of the high pressure feeder.

The relationship of the parameters indicated in FIG. 7 to the net positive suction head required (NPSHR) and to net positive suction head available(NPSHA)is, $$NPSHA=P_{SV}+H_1-\Delta P_{HPF}+H_2-H_{VP}>NPSHR \quad (1)$$

To ensure proper operation of pump 27 the NPSHA at the pump inlet 27'must be greater than the NPSHR of the pump. The NPSHR is defined by the characteristics of the pump and is provided by the pump manufacturer.

As shown in equation (1), the pressure in vessel 12, $P_{SV}$, contributes to the NPSHA. However, the contribution of $P_{SV}$for achieving NPSHR is reduced when the temperature of the chips exiting vessel 12, $T_2$, is reduced as discussed above. Therefore, when operating based upon the method of this invention, that is, with a lower slurry temperatures $T_1$ and $T_2$, the other variables in equation (1) must be adjusted to ensure that the NPSHR is achieved.

One method of insuring that the NPSHR of pump 27 is achieved is to increase the length of chute 14 and conduit 26 to increase $H_1$ and $H_2$ in equation (1). One disadvantage of this alternative is that the additional height would have to be accommodated at additional expense in the support structure and ancillary equipment.

Another method is to reduce the pressure drop across the transfer device, $\Delta P_{HPF}$, by, for example, increasing its speed of rotation, increasing its size, or streamlining its inlet geometry. Another method is to reduce the value of the NPSHR of pump 27 by either using a pump having a lower NPSHR, such as a centrifugal pump with an inducer (e.g. having an NPSHR at least about 20% lower than for conventional centrifugal pumps), for example, a "Hidrostal" pump as earlier described, or operating the pump at a lower speed.

After ensuring that the NPSHR of the pump 27 is available when modifying a conventional feed system, the system must then be designed to ensure that the pressure beneath the HPF 16 is not reduced below the vapor pressure $H_{VP}$ of the liquid in conduit 26. In other words, unless $$P_{SV}+H_1-\Delta P_{HPF}\geqq H_{VP} \quad (2)$$

the liquor exiting the HPF low-pressure outlet 20 will flash in the outlet or in conduit 26 and disrupt operation. Assuming that the pressure in vessel 12 $P_{SV}$, again which is related to the temperature in vessel 12, has been lowered as much as possible, and that the potential of raising the static head $H_1$ above the feeder 16 is limited, the only variable that can be modified is the pressure drop across the feeder 16, $\Delta P_{HPF}$. As mentioned above, various methods are available for reducing this pressure drop. However, reducing the pressure drop across the feeder 16 without reducing the rate of flow supplied by pump 27 to conduit 14 will increase the rate of flow of liquor through the feeder 16. If this flow is unchecked, the increased flow rate will produce turbulent flow through the feeder 16 and promote air entrainment in the liquor in and below the feeder in conduit 26. This is undesirable because the entrained air bubbles will cause cavitation under the reduced pressure conditions in and below the feeder and in the inlet of the pump. In order to prevent such air entrainment, in a preferred embodiment of this invention, some form of flow control is located in the chip chute circulation conduits 28 and 17. One example is shown in FIG. 6 and includes the flow meter 45, flow control valve 46 and flow controller 47. An alternative to flow control or in addition to flow control, the flow velocity through the HPF 16 can be reduced by recirculating some of the output of pump 27 to conduit 26, for example as shown in phantom as conduit 48 in FIG. 6.

Figure 8:
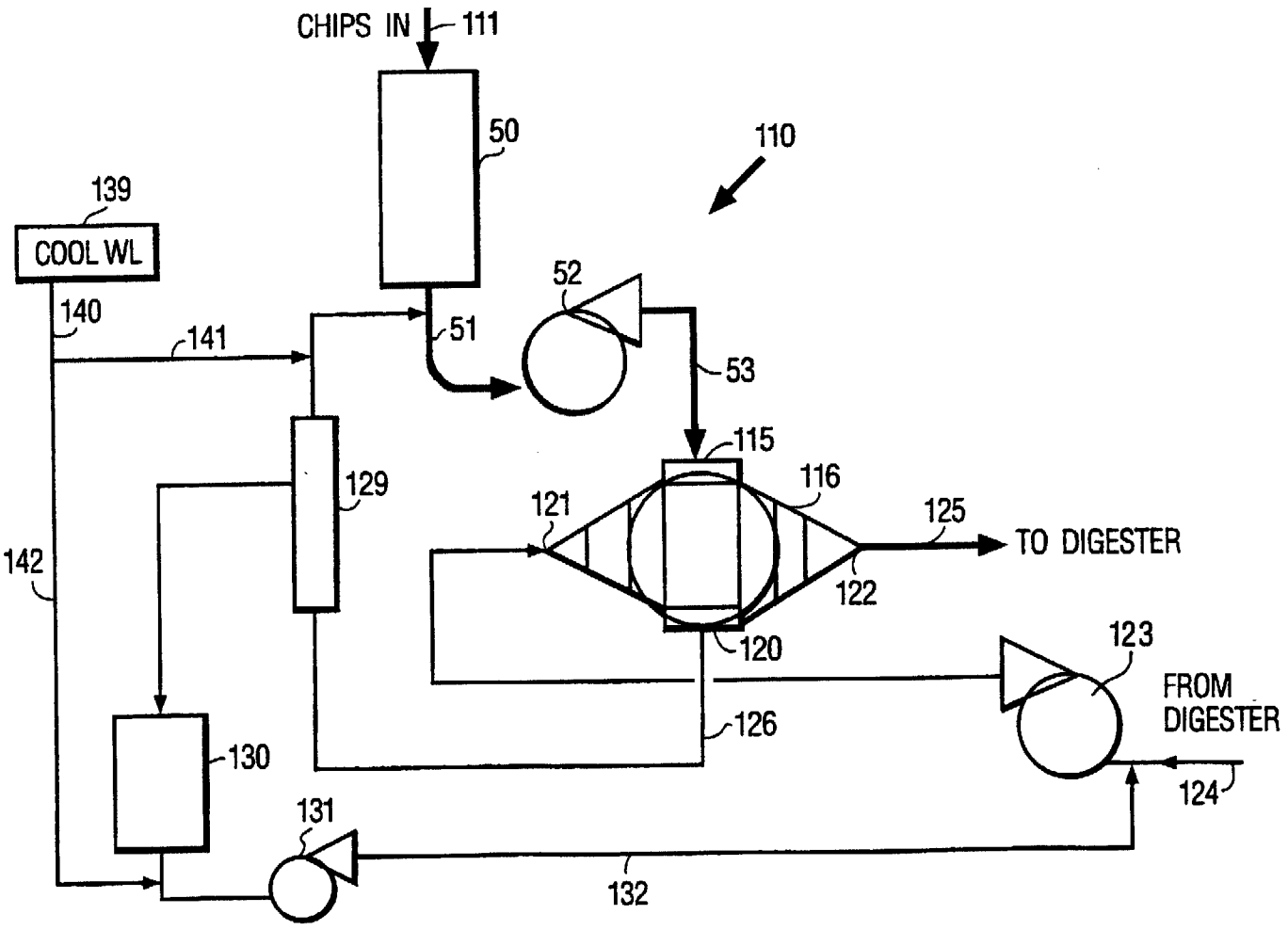
FIG. 8 is a view like that of FIG. 6 only showing an alternative configuration of equipment.

FIG. 8 illustrates another system 110 for practicing this invention. The system shown in FIG. 8 corresponds to the novel system disclosed in U.S. Pat. No. 5,476,572 and marketed under the trademark LO-LEVEL™ by Ahlstrom Machinery. Many of the items in FIG. 8 are identical to those in FIG. 6 and are identified by affixing a "1" to the original item number found in FIG. 6.

As disclosed in U.S. Pat. No. 5,476,572 (the disclosure of which is included by reference herein), the horizontal steaming vessel 12 and chip chute 14 of FIG. 6 are replaced by a vertical steaming vessel, 50, and a slurry pump, 52. The steaming vessel is preferably a vessel having single-convergence and side relief as disclosed in U.S. Pat. No. 5,500,083 and marketed by Ahlstrom Machinery under the trademark DIAMONDBACK® . The steaming vessel 50 discharges via conduit 51 to the inlet of the slurry pump 52. The conduit 51 preferably includes a radiused elbow such that the flow from vessel 50 to the inlet of pump 52 is smooth and unencumbered. For example, conduit 51 does not include any transitions that would stagnate flow to the pump. Preferably the return flow from conduit 126 via in-line drainer 129 (or from a liquor tank, not shown) is added tangentially to the elbow so that flow to the pump 52 is aided by the introduced liquor. This feeding of the pump 52 may be aided by the presence of a liquor tank (not shown) as disclosed in copending application Ser. No. 08/428,302 filed on Apr. 25, 1995 (the disclosure of which is included by reference herein). The slurry pump may be centrifugal-type pump such as a pump sold by Wemco under the name Hidrostal.

In contrast to the system shown in FIG. 6, the system shown in FIG. 8 is a "pump-through" system in which the slurry of chips and liquor is pumped into the HPF 16 and pump 27 (see FIG. 6) is unnecessary. One of the benefits of this system over the prior art is that the NPSHR of pump 27 does not need to be met via a static head $H_1$ or $H_2$(see FIG. 7), and the height of the system can be decreased. The system shown in FIG. 8 is a preferred system for operating according to the present invention because this system avoids any concern for the impact upon NPSHR of pump 27 when reducing the temperature $T_2$.

Also, the pretreatment performed in vessel 50, for example steaming, can typically be performed at atmospheric conditions so that the temperature of the chips entering conduit 51 are cooler than those exiting the vessel 12 of FIG. 6. Where in vessel 12 in FIG. 6 the chips are exposed to higher temperatures based on the need to performed pressurized treatment, as discussed above, such pressurized steaming is unnecessary in a system employing a DIAMONDBACK® steaming vessel. Also, in vessel 12 of FIG. 6, the reduction of temperature in the vessel is limited to the requirements of the NPSHR of pump 27, and can typically only be approximately 115° to 127° C. (240° to 260° F.). The chips exiting vessel 50 of FIG. 8 can be much cooler, for example, approximately 100° C. (212° F.) or cooler. Since cooler chips are introduced to the feeder 116 in FIG. 8, less or no cooling need be done in the FIG. 8 system compared to the system of FIG. 6.

For example, when implementing the present invention at a rate of 200 tons per day of air-dry fiber, the system of FIG. 6, having chips exiting vessel 12 at approximately 121° C. (250° F.) requires approximately 30,000 BTU per minute more cooling than the system of FIG. 8 having chips discharged from vessel 50 at approximately 100° C. (210° F.).

Figure 9:
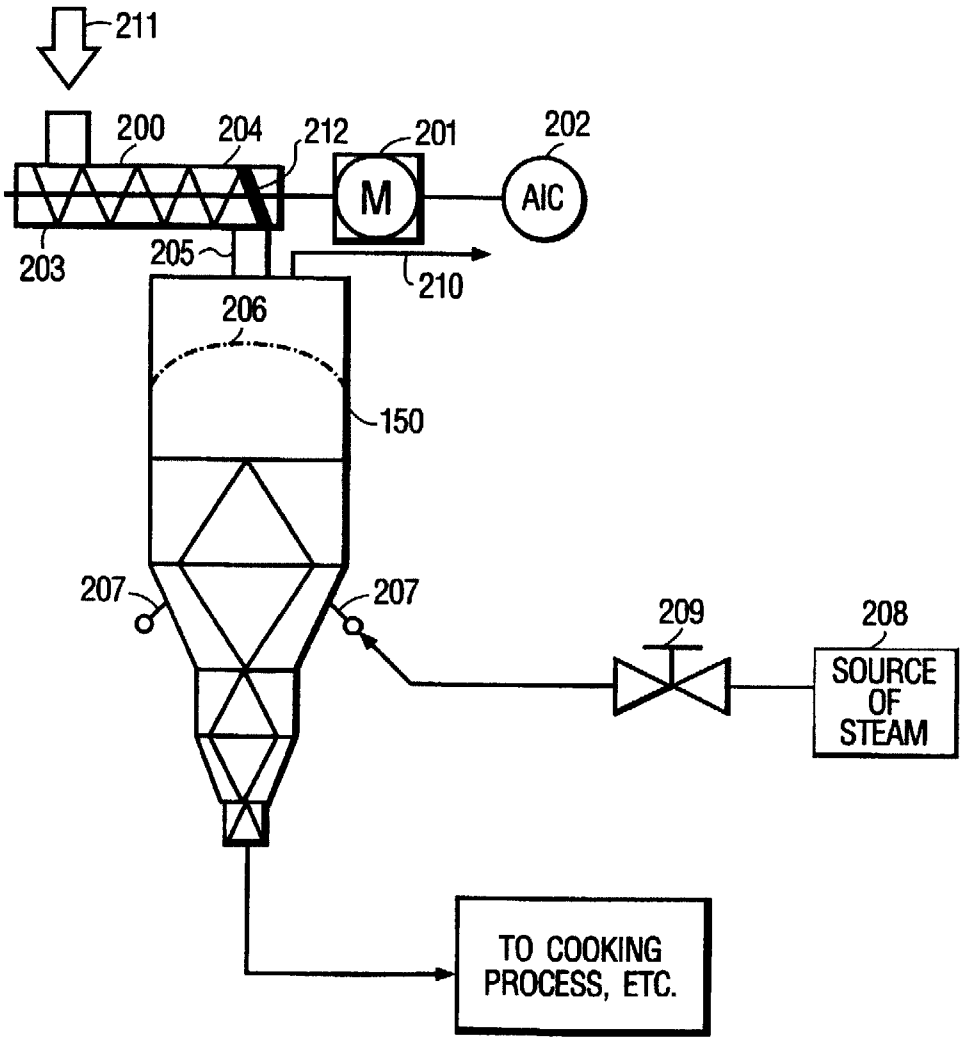
FIG. 9 is a schematic side view of a chip bin having one dimensional convergence and side relief for steaming chips utilizable in either conventional processors or in low temperature slurrying according to the invention.

One preferred embodiment of the system shown in FIG. 8 appears in FIG. 9. In FIG. 9 the vertical vessel 50 of FIG. 8 is replaced by DIAMONDBACK® chip bin 150, as disclosed in U.S. Pat. No. 5,500,083. The vessel 150 is fed by means of a horizontal screw conveyor 200 which is driven by electric motor 201. The motor may be a variable speed motor which is controlled by controller 202. The conveyor 200 has an inlet end 203 for receiving comminuted cellulosic fibrous material, 211, for example softwood chips, and a discharge end 204 for discharging material to vessel 150 via outlet conduit 205. The material is fed such that a level of material, 206, is maintained in vessel 150 and monitored by a level indicator (not shown), for example, a source and detector of radiation. Vessel 150 also typically includes a vent 210 for venting gases to the non-condensable gas (NCG) system.

Steam is added to vessel 150 by means of one or more inlets distributed around the vessel 150 and fed by a source of steam 208, for example, via one or more control valves 209. According to the invention, the steaming in vessel 150 is preferably performed at substantially atmospheric conditions such that the steamed material exiting vessel 150 is at approximately 100° C. (212° F.) or less. The steamed material is discharged from the outlet of vessel 150 without agitation or vibration, preferably, by passing it through one or more outlet transitions having a geometry with single-convergence and side-relief. From vessel 150 the material is directed to a steaming vessel 12 as in FIG. 6; or a slurry pump 52 as in FIG. 8; or directly to a high-pressure transfer device, 16, 116, for example, a HPF as sold by Ahlstrom Machinery.

The conveyor 200 may include a restriction 212 at its outlet end 204 such that an essentially gas-tight seal is produced between the material being conveyed and the conveyor housing, as disclosed in copending application Ser. No. 08/713,431 filed Sep. 13, 1996 (atty. dkt. 10-1194).

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods, systems and devices.

What is claimed is:

1. A method of treating comminuted cellulosic fibrous material, comprising the steps of:

(a) steaming the material so as to remove the air therefrom and heat the material to a temperature of 110° C. or less;

(b) substantially immediately after step (a), slurrying the material with kraft liquor, including cooking liquor, having a temperature of 110° C. or less so that the slurry has a temperature of 110° C. or less;

(c) substantially immediately after step (b), pressurizing the slurry and hydraulically feeding it to a treatment vessel, the temperature of the slurry being maintained at about 110° C. or less during pressurizing and feeding to the treatment vessel; and (d) in the treatment vessel raising the slurry temperature to a cooking temperature of at least 140° C. by bringing the material into contact with hot kraft cooking liquid.

2. A method as recited in claim 1 wherein steps (b) and (c) are practiced so that the material has a temperature of about 100° C. or less during pressurizing and feeding to the treatment vessel.

3. A method as recited in claim 1 wherein step (b) is practiced using a substantially vertical chute from a horizontal steaming vessel, a high pressure feeder at the bottom of the chute, the chute comprising a low pressure inlet to the high pressure feeder, a low pressure outlet from the high pressure feeder, a high pressure inlet to and a high pressure outlet from the high pressure feeder, and a low pressure pump connected between the low pressure outlet from the high pressure feeder and the chute; and wherein the low pressure pump has a net positive suction head required which is less than a net positive suction head available, the net positive suction head available=

$$NPSHA=P_{SV}+H_1-\Delta P_{HPF}+H_2-H_{VP}>NPSHR \quad (1)$$

wherein $P_{SV}$=the pressure in the horizontal steaming vessel outlet, $H_1$ is the static head of the liquid above the high pressure feeder, $\Delta P_{HPF}$ is the pressure drop across the high pressure feeder; $H_2$ is the static head between the high pressure feeder and the low pressure pump inlet; and $H_{VP}$ is the vapor pressure of the liquid between the low pressure outlet from the high pressure feeder and the low pressure pump inlet, the value $H_{VP}$ being dependent upon the temperature of the material in the chute, the temperature of the material in the high pressure feeder high pressure outlet, and the temperature between the high pressure feeder low pressure outlet and the low pressure pump inlet; and wherein steps (b) and (c) are practiced so that the temperature in the chute is controlled so that the net positive suction head required for the low pressure pump is provided while the temperature in the chute is maintained at about 110° C. or below.

4. A method as recited in claim 1 wherein step (a) is practiced for a time period of about 15–35 minutes at a pressure of about 3 psig or less, and so that the material has a temperature of about 105° C. or less.

5. A method as recited in claim 1 wherein step (a) is practiced for a time period of about 20–30 minutes so that the material has a temperature of about 100° C. or less, and at substantially atmospheric pressure; and wherein steps (b) and (c) are practiced so as to maintain the temperature of the slurry at about 100° C. or less during pressurizing and feeding to the treatment vessel.

6. A method as recited in claim 5 wherein steps (a)–(d) are practiced so that the pulp produced has strength properties at least 10% greater than pulp produced when the temperatures in steps (a)–(c) are greater than 110° C.

7. A method as recited in claim 5 wherein steps (a)–(d) are practiced so that the pulp produced has strength properties at least 20% greater than pulp produced when the temperatures in steps (a)–(c) are greater than 110° C.

8. A method as recited in claim 1 wherein step (b) is practiced by positively cooling at least part of the liquor used for slurrying the material.

9. A method as recited in claim 1 wherein steps (a)–(d) are practiced so that the pulp produced has strength properties at least 10% greater than pulp produced when the temperatures in steps (a)–(c) are greater than 110° C.

10. A method of treating comminuted cellulosic fibrous material using a high pressure transfer device and a liquid transfer device, comprising the steps of:

(a) steaming the material so as to remove the air therefrom and heat the material to a temperature of 110° C. or less;

(b) substantially immediately after step (a), slurrying the material with liquor, including cooking liquor, having a temperature of 110° C. or less so that the slurry has a temperature of 110° C. or less;

(c) drawing the slurry of step (b) into the high-pressure transfer device using the liquid transfer device;

(d) pressurizing the slurry in the high pressure transfer device and hydraulically feeding the slurry from the high pressure transfer device to a treatment vessel, the temperature of the slurry being maintained at about 110° C. or less during pressurizing and feeding to the treatment vessel; and (e) in the treatment vessel, raising the slurry temperature to a cooking temperature of at least 140° C. by bringing the material into contact with hot liquid.

11. A method as in claim 10, wherein step (c) is practiced by using as the liquid transfer device a pump which has an NPSHR less than the NPSHA.

12. A method as recited in claim 10 wherein step (c) is practiced by using as the liquid transfer device a centrifugal pump with an inducer having an NPSHR at least 20% lower than conventional centrifugal pumps.

13. A method as recited in claim 10 wherein steps (a)–(e) are practiced to produce a pulp having strength properties at least 10% greater than pulp produced by material having a temperature of greater than 110° C. during the practice of steps (a)–(d).

14. Apparatus for treating comminuted cellulosic material to produce cellulose pulp, comprising:

means for steaming the material to a temperature of 110° C. or less at a pressure of about 5 psig or less, to remove air therefrom;

a high pressure feeder having an inlet connected to said steaming means and an outlet;

a pump disposed between said steaming means and said high pressure feeder for forcing slurry into said high pressure feeder inlet so that the slurry in said high pressure feeder has a temperature of 110° C. or less; and a digester operatively connected to said high pressure feeder outlet.

15. Apparatus as recited in claim 14 wherein said pump is connected to said steaming means by a conduit including a radiused elbow so that the flow of slurry from said steaming means to said pump is smooth and unencumbered, being devoid of transitions that could stagnate flow.

16. Apparatus as recited in claim 14 wherein said steaming means comprises a substantially atmospheric chip bin with one-dimensional convergence and side relief.

17. A method of treating comminuted cellulosic fibrous material, comprising the steps of:

(a) steaming the material so as to remove the air therefrom and heat the material to a temperature of 110° C. or less;

(b) substantially immediately after step (a), slurrying the material with kraft liquor, including cooking liquor, having a temperature of 110° C. or less so that the slurry has a temperature of 110° C. or less;

(c) pressurizing the slurry and hydraulically feeding it to a treatment vessel, the temperature of the slurry being maintained at about 110° C. or less during pressurizing and feeding to the treatment vessel; and (d) in the treatment vessel raising the slurry temperature to a cooking temperature of at least 140° C. by bringing the material into contact with hot liquid; and wherein step (b) is practiced using a substantially vertical chute from a horizontal steaming vessel, a high pressure feeder at the bottom of the chute, the chute comprising a low pressure inlet to the high pressure feeder, a low pressure outlet from the high pressure feeder, a high pressure inlet to and a high pressure outlet from the high pressure feeder, and a low pressure pump connected between the low pressure outlet from the high pressure feeder and the chute; and wherein the low pressure pump has a net positive suction head required which is less than a net positive suction head available, the net positive suction head available=

$$NPSHA=P_{SV}+H_1-\Delta P_{HPF}+H_2-H_{VP}>NPSHR \quad (1)$$

wherein $P_{SV}$=the pressure in the horizontal steaming vessel outlet, $H_1$ is the static head of the liquid above the high pressure feeder, $\Delta P_{HPF}$ is the pressure drop across the high pressure feeder; $H_2$ is the static head between the high pressure feeder and the low pressure pump inlet; and $H_{VP}$ is the vapor pressure of the liquid between the low pressure outlet from the high pressure feeder and the low pressure pump inlet, the value $H_{VP}$ being dependent upon the temperature of the material in the chute, the temperature of the material in the high pressure feeder high pressure outlet, and the temperature between the high pressure feeder low pressure outlet and the low pressure pump inlet; and wherein steps (b) and (c) are practiced so that the temperature in the chute is controlled so that the net positive suction head required for the low pressure pump is provided while the temperature in the chute is maintained at about 110° C. or below.

18. Apparatus for treating comminuted cellulosic material to produce cellulose pulp, comprising:

means for steaming the material to a temperature of 110° C. or less at a pressure of about 5 psig or less, to remove air therefrom;

a high pressure feeder having an inlet connected to said steaming means and an outlet;

a pump for drawing slurry into said high pressure feeder inlet, said pump having an NPSHR less than the NPSHA, so that the slurry in said high pressure feeder has a temperature of 110° C. or less; and a digester operatively connected to said high pressure feeder outlet.

19. Apparatus as recited in claim 18 wherein said pump comprises a centrifugal pump with an inducer.

20. Apparatus as recited in claim 18 wherein said steaming means comprises a horizontal steaming vessel.

* * * * *